US010183843B2

(12) United States Patent
Hu et al.

(10) Patent No.: US 10,183,843 B2
(45) Date of Patent: Jan. 22, 2019

(54) MONITORING OF STEP ROLLERS AND MAINTENANCE MECHANICS OF PASSENGER CONVEYORS

(71) Applicant: Otis Elevator Company, Farmington, CT (US)

(72) Inventors: ZhaoXia Hu, Zhejiang (CN); JianGuo Li, Zhejiang (CN); Alois Senger, Gresten (AT); Hui Fang, Shanghai (CN); Zhen Jia, Shanghai (CN); Jianwei Zhao, Shanghai (CN); Qiang Li, Shanghai (CN); Anna Su, Shanghai (CN); Alan Matthew Finn, Hebron, CT (US); Wei Ge, Haining (CN); Yanying Chen, Guangzhou (CN); LongWen Wang, Shanghai (CN); DuEon Kim, Gyeonggi-do (KR)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/663,441

(22) Filed: Jul. 28, 2017

(65) Prior Publication Data

US 2018/0029834 A1 Feb. 1, 2018

(30) Foreign Application Priority Data

Jul. 29, 2016 (CN) ..... 2016 1 0609990

(51) Int. Cl.
*B66B 25/00* (2006.01)
*B66B 21/02* (2006.01)
(Continued)

(52) U.S. Cl.
CPC ..... *B66B 25/006* (2013.01); *B66B 21/02* (2013.01); *B66B 23/145* (2013.01); *B66B 25/003* (2013.01); *B66B 29/005* (2013.01)

(58) Field of Classification Search
CPC ..... B66B 29/06; B66B 25/006; B66B 25/003; B66B 21/02
See application file for complete search history.

(56) References Cited

U.S. PATENT DOCUMENTS 4,653,109 A * 3/1987 Lemelson ..... G06T 7/00 348/701
5,072,820 A 12/1991 Steffen et al.
(Continued)

FOREIGN PATENT DOCUMENTS

CN 201520587 U 7/2010
CN 102055959 A 5/2011
(Continued)

OTHER PUBLICATIONS

Computer Weekly, [online]; [retreived on Jul. 27, 2017]; retreived from the Internethttp://www.computerweekly.com/feature/Tube-Lines-gets-smart-to-monitor-escalator-wearCliff Saran, "Tube Line gets smart to monitor escalator wear," ComputerWeekly.com, Jan. 2008, pp. 1-5.
(Continued)

*Primary Examiner* — Gene O Crawford
*Assistant Examiner* — Lester III Rushin
(74) *Attorney, Agent, or Firm* — Cantor Colburn LLP

(57) ABSTRACT

The present invention relates to step roller monitoring and maintenance personnel monitoring of a passenger conveyor, and belongs to the field of passenger conveyor technologies. In the monitoring system and monitoring method of the present invention, an imaging sensor and/or a depth sensing sensor is used to sense the step roller/maintenance personnel of the passenger conveyor to acquire data frames, and the data frames are analyzed and processed to monitor whether the movement or position of the step roller/activity or position of the maintenance personnel is in a normal state.

21 Claims, 7 Drawing Sheets

(51) Int. Cl.
*B66B 23/14* (2006.01)
*B66B 29/00* (2006.01)

(56) References Cited

U.S. PATENT DOCUMENTS

| | | | | |
|---|---|---|---|---|
| 5,236,075 | A | 8/1993 | Bartmann | |
| 5,316,121 | A * | 5/1994 | Zaharia | B66B 29/005 198/323 |
| 6,349,813 | B1 | 2/2002 | Offerman et al. | |
| 7,225,912 | B1 | 6/2007 | Toennisson et al. | |
| 2008/0283342 | A1 | 11/2008 | Deplazes et al. | |
| 2012/0103756 | A1 | 5/2012 | Braasch et al. | |

FOREIGN PATENT DOCUMENTS

| | | | |
|---|---|---|---|
| CN | 102320514 | A | 1/2012 |
| CN | 104215179 | A | 12/2014 |
| JP | 2010265078 | A | 11/2010 |
| JP | 2012180187 | A | 9/2012 |
| WO | 2008012866 | A1 | 1/2008 |

OTHER PUBLICATIONS

P. Welch, et al., "Remote Monitoring of Elevators and Escalators: Managing the Alarms and the Maintenance," Vtexcellence.com, Vertical Transit—Going up; Track 5—Technical Forums; Apr. 27, 2011; pp. 1-4.

Pliem, et al., "Crack Detection on an Escalator Handrail," IEEE Proceedings of the 19th IEEE Instrumentation and Measurement Technology Conference, May 21-23, 2002, pp. 1001-1005.

Schindler Modernization, "Schindler Escalator Upgrade Programs New Technology for Older Equipment," Schindler, Schindler Escalator Upgrade, Aug. 5, 2010; pp. 1-12.

Extended European Search Report issued in EP Application No. 17184126.5 dated Dec. 12, 2017, 9 pages.

* cited by examiner

MONITORING OF STEP ROLLERS AND MAINTENANCE MECHANICS OF PASSENGER CONVEYORS

FOREIGN PRIORITY

This application claims priority to Chinese Patent Application No. 201610609990.8, filed Jul. 29, 2016, and all the benefits accruing therefrom under 35 U.S.C. § 119, the contents of which in its entirety are herein incorporated by reference.

FIELD OF THE INVENTION

The present invention belongs to the field of passenger conveyor technologies, and relates to foreign matter automatic monitoring during movement of a step roller of a passenger conveyor and automatic monitoring for activities of maintenance personnel.

BACKGROUND OF THE INVENTION

A passenger conveyor (such as an escalator or a moving walkway) is increasingly widely used in public places such as subways, shopping malls, and airports, and operation safety thereof is increasingly important.

During movement, steps of the passenger conveyor may bounce due to some reasons, causing damage to the steps or even risks to passengers thereon. The step bouncing problem may occur due to abnormal operation of the step roller as a guide rail is deformed, or a guide rail joint is not flat, or a foreign matter is stuck in an operation trajectory, and phenomena such as step bouncing, upthrusting or sagging at the corresponding trajectory may occur. Therefore, normal operation of the step roller is one of the essential conditions for ensuring safe operation of the steps.

SUMMARY OF THE INVENTION

According to a first aspect of the present invention, a step roller monitoring system of a passenger conveyor is provided, including: an imaging sensor and/or a depth sensing sensor configured to sense at least a part of the step rollers of the passenger conveyor to acquire data frames; and a processing device configured to analyze and process the data frames to monitor whether the movement of the operating step roller and/or a position of the static step roller is in a normal state, wherein the normal state refers to that the step roller moves in a predetermined trajectory pattern.

According to a second aspect of the present invention, a step roller monitoring method of a passenger conveyor is provided, including steps of: sensing, by an imaging sensor and/or a depth sensing sensor, at least a part of the step rollers of the passenger conveyor to acquire data frames; and analyzing and processing the data frames to monitor whether the movement of the operating step roller and/or a position of the static step roller is in a normal state, wherein the normal state refers to that the step roller moves in a predetermined trajectory pattern.

According to a third aspect of the present invention, a monitoring system for monitoring actions of maintenance personnel of a passenger conveyor is provided, including: an imaging sensor and/or a depth sensing sensor configured to sense the maintenance personnel to acquire data frames; and a processing device configured to analyze and process the data frames to monitor whether an activity and/or a position of the maintenance personnel is in a normal state, wherein the normal state refers to that the activity and/or position of the maintenance personnel is in one or more predetermined trajectory patterns.

According to a fourth aspect of the present invention, a method for monitoring activities of maintenance personnel of a passenger conveyor is provided, including steps of: sensing, by an imaging sensor and/or a depth sensing sensor, the maintenance personnel to acquire data frames; and analyzing and processing the data frames to monitor whether the activity of the maintenance personnel is in a normal state, wherein the normal state refers to that the activity and/or position of the maintenance personnel is in one or more predetermined trajectory patterns.

According to a fifth aspect of the present invention, a passenger conveying system is provided, including a passenger conveyor and the monitoring system described above.

The foregoing features and operations of the present invention will become more evident according to the following descriptions and accompanying drawings.

DESCRIPTION OF THE DRAWINGS

In the following detailed description with reference to the accompanying drawings, the foregoing and other objectives and advantages of the present invention would be more complete and clearer, wherein identical or similar elements are indicated with identical reference signs.

DETAILED DESCRIPTION OF THE EMBODIMENTS

The present invention is now described more completely with reference to the accompanying drawings. Exemplary embodiments of the present invention are illustrated in the accompanying drawings. However, the present invention may be implemented in lots of different forms, and should not be understood as being limited to the embodiments described herein. On the contrary, the embodiments are provided to make the disclosure thorough and complete, and fully convey the concept of the present invention to those skilled in the art.

Some block diagrams shown in the accompanying drawings are functional entities, and do not necessarily correspond to physically or logically independent entities. The functional entities may be implemented in the form of software, or the functional entities are implemented in one or more hardware modules or an integrated circuit, or the functional entities are implemented in different processing devices and/or microcontroller devices.

In the present invention, the passenger conveyor includes an escalator and a moving walkway. In the following illustrated embodiments, the step roller monitoring system and monitoring method according to the embodiments of the present invention are described in detail by taking the escalator as an example. However, it should be appreciated that the step roller monitoring system and monitoring method for an escalator in the following embodiments may also be analogically applied to a moving walkway. Adaptive improvements or the like that may need to be performed can be obtained by those skilled in the art with the teachings of the embodiments of the present invention.

It should be noted that, in the present invention, the movement of the step roller of the passenger conveyor is in a "normal state" refers to that the step roller moves in a predetermined trajectory pattern; on the contrary, an "abnormal state" refers to that the step roller does not move in the predetermined trajectory pattern, for example, the step roller upthrusts, bounces, sags, or the like during movement. When the movement of the step roller is in the abnormal state, steps may run abnormally, which may cause danger to passengers on the steps. Therefore, it is necessary to avoid an abnormal state of the movement of the step roller, or detect in real time that the movement of the step roller is in an abnormal state. The "movement" in the present invention includes time derivatives of all positions, for example, including but not limited to rate, acceleration, jitter and the like.

The predetermined trajectory pattern may be a pattern region formed by a combination of permitted trajectories. The predetermined trajectory pattern is a relative concept, and may be set according to a specific situation, for example, if the safety requirement on the passenger conveyor is higher, the pattern region is smaller, requiring the step roller to operate more precisely.

Figure 1:
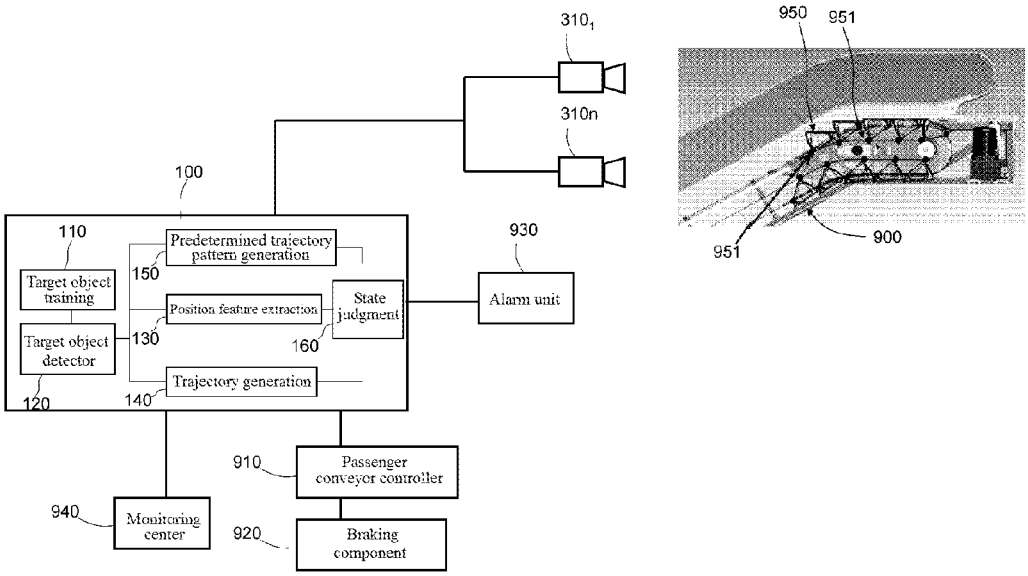
FIG. 1 is a schematic structural diagram of a step roller monitoring system of a passenger conveyor according to an embodiment of the present invention.
Figure 2:
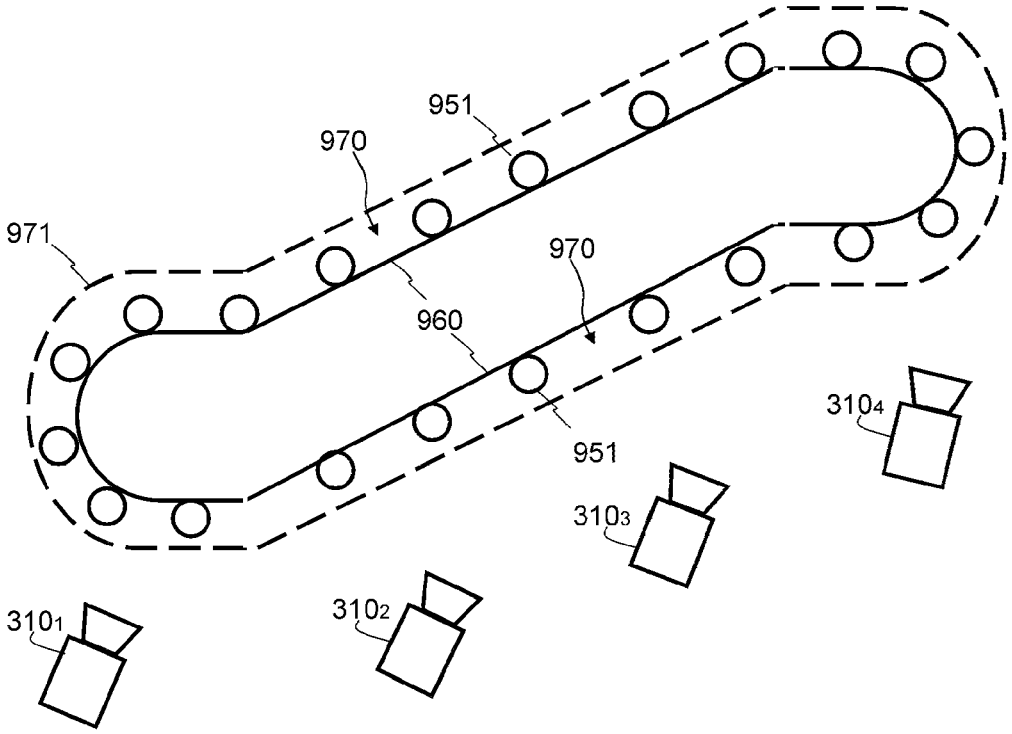
FIG. 2 is a schematic diagram of mounting of a sensing device of a passenger conveyor according to an embodiment of the present invention.
Figure 3:
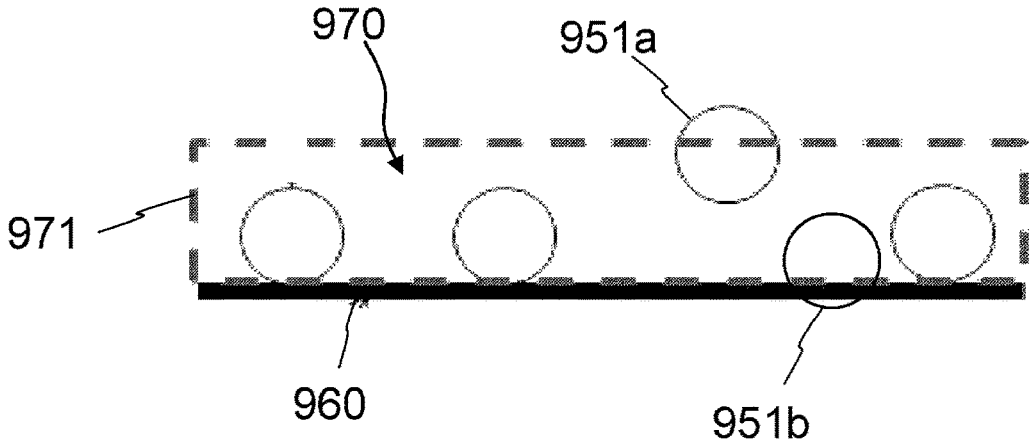
FIG. 3 is a schematic diagram of an example of judging whether the movement of the step roller in the step roller monitoring system shown in FIG. 1 is in a normal state.

FIG. 1 is a schematic structural diagram of a step roller monitoring system of a passenger conveyor according to an embodiment of the present invention, FIG. 2 is a schematic diagram of mounting of a sensing device of a passenger conveyor according to an embodiment of the present invention, and FIG. 3 is a schematic diagram of an example of judging whether the movement of the step roller in the step roller monitoring system shown in FIG. 1 is in a normal state.

As shown in FIG. 1 to FIG. 3, the step roller monitoring system of this embodiment may be used to continuously monitor, in a predetermined time period, whether the movement of a step roller 951 corresponding to each step 950 of an escalator 900 is in a normal state when the passenger conveyor is in a daily operation condition (including an operation condition with passengers and a no-load operation condition without passengers).

In the daily operation condition, the steps 950 continuously run in a cycle along a direction at a predetermined speed, and run in a cycle synchronously with the step rollers 951. FIG. 2 is a side view during movement of the step rollers 951. In the normal state, the step rollers 951 run along a trajectory 960, and an area between the dashed line and the trajectory 960 illustrates an example of a predetermined trajectory pattern 970. In order to ensure the operation safety of the steps, generally, it is required that the step rollers 951 do not exceed the range of the predetermined trajectory pattern 970 during movement. If the step rollers 951 operate out of the range of the predetermined trajectory pattern 970, it indicates that the operation of the step rollers 951 and the steps 950 brings risks to passengers on the escalator 900.

The step roller monitoring system in the embodiment shown in FIG. 1 includes a sensing device 310 and a processing device 100 coupled to the sensing device 310. The escalator 900 includes a passenger conveyor controller 910, a braking component 920 such as a motor, and an alarm unit 930, and the like.

The sensing device 310 is specifically an imaging sensor or a depth sensing sensor, or a combination thereof. According to a specific requirement and a monitoring range of the sensor, the escalator 900 may be provided with one or more sensing devices 310 therein, such as $\mathbf{310}_1$ to $\mathbf{310}_n$, N being an integer greater than or equal to 1. The sensing devices 310 are mounted in such a manner that they can relatively clearly and accurately sense the moving or static step rollers 951 of the escalator 900. The specific mounting manner and mounting positions thereof are not limited. In the embodiment shown in FIG. 1, a scene that can be sensed by the sensing device 310 is shown, that is, the sensing device 310 can sense a scene on a side face of the step roller 951 of the escalator 900. In the embodiment shown in FIG. 2, for example, four sensing devices $\mathbf{310}_1$ to $\mathbf{310}_4$ are used to sense the scene on the side faces of the step rollers 951. The sensing devices $\mathbf{310}_1$ to $\mathbf{310}_4$ are all mounted approximately facing the side faces of the steps 950 of the passenger conveyor 900. In this way, the movement trajectory of the step rollers 951 can be acquired more accurately. Moreover, the sensing devices $\mathbf{310}_1$ to $\mathbf{310}_4$ are all mounted inside the escalator 900. In this case, as a depth sensor can sense and acquire depth maps without relying on ambient light, when the sensing device 310 is a depth sensor, relatively clear depth maps can be obtained. If the sensing device 310 is an imaging sensor, a lighting part may be mounted inside the escalator 900 correspondingly, which can illuminate the step rollers 951, thus helping the imaging sensor to obtain a clear image frame.

It should be noted that, it may be necessary to monitor the movement of all the step rollers 951 operating on the trajectory 960. Therefore, the number of sensing devices 310 that need to be mounted may be determined according to the range of a monitoring viewing angle of the device and the like, and the specific number is not limited. Each sensing device 310 senses step rollers 951 operating on a corresponding part of the trajectory 960, and corresponding analysis and processing is performed in the processing device 100. Definitely, only one sensing device 310 may be used if only step rollers 951 operating on part of the trajectory 960 are monitored.

The imaging sensor may be various types of 2D image sensors. It should be appreciated that any image sensor capable of capturing an image frame including pixel grayscale information may be applied here. Definitely, image sensors capable of capturing an image frame including pixel grayscale information and color information (such as RGB information) may also be applied here.

The depth sensing sensors may be specific to any 1D, 2D or 3D depth sensor or a combination thereof. In order to accurately sense a handrail part and the like of the step roller 951 and the possible foreign matter, a corresponding type of depth sensing sensor may be selected according to a specific application environment. Such a sensor is operable in an optical, electromagnetic or acoustic spectrum capable of producing a depth map (also known as a point cloud or occupancy grid) with a corresponding texture. Various depth sensing sensor technologies and devices include, but are not limited to, structural light measurement, phase shift measurement, time-of-flight measurement, a stereo triangulation device, an optical triangulation measurement plate, a light field camera, a coded aperture camera, a computational imaging technology, simultaneous localization and mapping (SLAM), imaging radar, imaging sonar, an echolocation apparatus, a scanning LIDAR, a flash LIDAR, a passive infrared (PIR) sensor and a small focal plane array (FPA) or a combination including at least one of the foregoing. Different technologies may include active (transmitting and receiving a signal) or passive (only receiving a signal) technologies that are operable in a band of the electromagnetic or acoustic spectrum (such as visual and infrared). The use of depth sensing may have specific advantages over conventional 2D imaging. Infrared sensing may achieve particular benefits over visible spectrum imaging. Alternatively or additionally, the sensor may be an infrared sensor with one or more pixels of spatial resolution, e.g., a passive infrared (PIR) sensor or a small IR focal plane array (FPA).

It should be noted that there may be property or quantity differences between a 2D imaging sensor (e.g., a conventional security camera) and the 1D, 2D, or 3D depth sensing sensor in terms of the extent that the depth sensing provides numerous advantages. In 2D imaging, a reflected color (a mixture of wavelength) from a first object in each radial direction from an imager is captured. A 2D image, then, may include a combined spectrum of a source lighting and a spectral reflectivity of an object in a scene. The 2D image may be interpreted by a person as a picture. In the 1D, 2D, or 3D depth-sensing sensor, there is no color (spectral) information; more specifically, a distance (depth, range) to a first reflection object in a radial direction (1D) or directions (2D, 3D) from the sensor is captured. The 1D, 2D, and 3D technologies may have inherent maximum detectable range limits and may have a spatial resolution lower than that of a typical 2D imager. In terms of relative immunity to ambient lighting problems, compared with the conventional 2D imaging, the 1D, 2D, or 3D depth sensing may advantageously provide improved operations, better separation of occluding objects, and better privacy protection. Infrared sensing may achieve particular benefits over visible spectrum imaging. For example, it is possible that a 2D image cannot be converted into a depth map and a depth map does not have a capability of being converted into a 2D image (for example, artificial allocation of continuous colors or brightness to continuous depths may cause a person to roughly interpret a depth map in a manner somewhat akin to how a person sees a 2D image, while the depth map is not an image in a conventional sense).

When the sensing device 310 is specifically a combination of an imaging sensor and a depth sensing sensor, the sensing device 310 may be an RGB-D sensor, which can simultaneously acquire RGB information and depth (D) information.

The sensing device 310 senses the step roller 951 of the escalator 900 and acquires a plurality of continuous data frames, that is, sequence frames, in real time. If an imaging sensor is used for sensing and acquisition, the sequence frames are multiple image frames, and each pixel therein has, for example, corresponding grayscale information and color information; if a depth sensing sensor is used for sensing and acquisition, the sequence frames are multiple depth maps, and each pixel or occupancy grid therein also has corresponding a depth dimension (reflecting depth information).

The foregoing process of sensing and acquiring data frames by the sensing device 310 may be implemented under control of the processing device 100 or the passenger conveyor controller 910. The data frames sensed and acquired by the sensing device 310 are further sent to the processing device 100. The processing device 100 is further responsible for analyzing and processing each data frame, and finally determining information indicating whether the step roller 951 of the escalator 900 is in a normal state, for example, determining whether any step roller 951 bounces out of the predetermined trajectory pattern 970.

Further as shown in FIG. 1, the processing device 100 is configured to include a target object detector 120, which is configured to detect a target object related to the step roller 951 from the data frames acquired by the sensing device 310. In this way, a target object corresponding to the step roller 951 is distinguished from each data frame, to facilitate subsequent processing on the target object. In an embodiment, the target object detector 120 may obtain the target object through learning and training in advance. Therefore, the processing device 100 is further provided with a target object training module 110; the target object training module 110 first acquires at least one data frame sensed when the movement of the step roller 951 is in a normal state, and the data frame includes the step roller 951. The step roller 951 in the data frame is manually identified, for example, a two-dimensional boundary (if the data frame is a two-dimensional image) or a three-dimensional boundary (if the data frame is a three-dimensional depth map) corresponding to the step roller 951 is identified. Further, by using a graphic classification algorithm and the like, and by using a data frame portion corresponding to the identified step roller 951, a target object model related to the step roller 951 is obtained through learning and training. The target object model includes features such as the shape, size, color (if any), and action of the step roller 951, and therefore, the target object model reflects lots of feature information of the step roller 951. By using the target object model trained by the target object training module 110, the target object detector 120 can accurately detect or identify the target object related to the step roller 951 from a subsequent data frame acquired online or offline.

It should be noted that, the detection accuracy degree of the target object detector 120 is related to a learning and training effect of the target object training module 110. If the learning and training are performed more times, it is possible that the target object model can more accurately reflect feature information about the step roller 951, and therefore the target object related to the step roller 951 can be detected more accurately. The learning and training process of the target object training module 110 for the step roller 951 may be finished offline in advance. The target object detector 120 may continuously operate online, to continuously detect the target object related to the step roller 951 in each data frame.

In another alternative embodiment, the target object detector 120 may detect a circular target object of the step roller 951 and so on by using, for example, Hough Circle Transform, a closed contour algorithm (wherein the contour has a constant curvature) or the like.

Further, as shown in FIG. 1, the processing device 100 is further provided with a position feature extraction module 130. The position feature extraction module 130 extracts a corresponding feature from the detected target object, especially including extracting a position feature of the target object. Information such as the position feature may be defined by distance values (2D plane distances or 3D distances) from multiple feature points or pixels/grids of the target object to a reference point.

Further, as shown in FIG. 1, the processing device 100 is further provided with a state judgment module 160. The state judgment module 160 may be coupled to the position feature extraction module 130, and acquire the position feature of the target object related to the step roller 951 extracted by the position feature extraction module 130. Moreover, the state judgment module 160 may further store or provided in advance with a predetermined trajectory pattern 970. The state judgment module 160 judges, based on the position feature of the target object related to one or more step rollers 951 corresponding to each data frame, whether the target object is in the predetermined trajectory pattern, and determines that the movement of the corresponding step roller 951 is in a normal state when the judgment result is "yes".

Specifically, as shown in FIG. 3, a region enclosed by the dashed line 971 is the predetermined trajectory pattern 970 in data frame coordinates. 951*a* and 951*b* are target objects corresponding to two step rollers 951 on the data frame, and the position features thereof are extracted and compared with the predetermined trajectory pattern 970; it can be judged that the target objects 951*a* and 951*b* of the step rollers 951 are not completely located in the predetermined trajectory pattern 970. Therefore, it indicates that at the moment corresponding to the data frame, the movement of the two step rollers 951 is in an abnormal state, wherein the step roller corresponding to the target object 951*a* may be in an upthrusting process, and the step roller corresponding to the target object 951*b* may be in a sagging process. This judgment method may be applied to data frames acquired when the step rollers 951 are in a static state. The position features corresponding to the static step rollers 951 are extracted, and by comparing the position features with the predetermined trajectory pattern 970, it can be judged that the target objects 951*a* and 951*b* of the step rollers 951 are not completely located in the predetermined trajectory pattern 970, thus judging whether the positions of the step rollers 951 are in a normal state. In this case, the normal state refers to that the positions of the step rollers are correspondingly in the predetermined trajectory pattern.

The judgment manner in the judgment module 160 in the foregoing embodiment is making a judgment based on the processing result of one data frame to obtain a movement state result of the step roller 951.

Further, as shown in FIG. 1, the processing device 100 is further provided with a trajectory generation module 140. The trajectory generation module 140 generates one or more movement trajectories related to the target object according to position features of the target object that are obtained correspondingly according to a plurality of continuous data frames. Specifically, the position features obtained by the position feature extraction module 130 and the target object detected by the target object detector 120 are processed in the trajectory generation module 140. In the trajectory generation module 140, a Bayesian Filter technology is used to trace a same target object in continuous data frames. In this way, among multiple target objects obtained from data frames in a predetermined time period, a same corresponding target object may be obtained by means of tracing. Further, based on position information (obtained from the position feature extraction module 130) of the same target object traced in each data frame, one or more movement trajectories of the step roller 951 corresponding to the target object in the predetermined time period are generated. The specific Bayesian Filter technology may be, but not limited to, Kalman Filter, Particle Filter, and the like. Correspondingly, the state judgment module 160 may be coupled to the trajectory generation module 140, and judge, based on the movement trajectory of the corresponding target object in the predetermined time period and the predetermined trajectory pattern 970, whether the movement trajectory is in the predetermined trajectory pattern 970. If the judgment result is "yes", it indicates that the movement of the step roller 951 corresponding to the target object in the predetermined time period is in a normal state; otherwise, the movement is in an abnormal state.

In the foregoing embodiment, judgment by the state judgment module 160 based on the movement trajectory is a dynamic judgment process, and the judgment is made based on multiple data frames. Therefore, the judgment is relatively more accurate and reasonable, and the judgment result has high credibility. For example, if a relatively large error occurs randomly during target object detection on a data frame, and if the judgment on whether the target object is in the predetermined trajectory pattern 970 is made based on the position feature corresponding to the erroneous detection result, misjudgment may occur. Especially, after the filtering technology is used during the process of generating the movement trajectory, when a large error randomly occurs in target object detection on a data frame, the detection result may be directly filtered out, thus significantly improving the judgment accuracy.

In an embodiment, as shown in FIG. 1, the processing device 100 is further provided with a predetermined trajectory pattern generation module 150, which may generate the predetermined trajectory pattern of the step roller 951 based on a plurality of continuous data frames sensed when the movement of the step roller 951 is in the normal state. The predetermined trajectory pattern generation module 150 is coupled to the target object detector 120 and the position feature extraction module 130, and the principle of generating a predetermined trajectory thereof is basically the same as the principle of generating the movement trajectory by the trajectory generation module 140, only that different data frames are used; descriptions of the predetermined trajectory pattern generation module 150 are omitted herein. The predetermined trajectory obtained by the predetermined trajectory pattern generation module 150 is a standard movement trajectory obtained in the normal state. It should be appreciated that, the predetermined trajectory pattern 970 can be generated by adding a range (such as a tolerable range or an allowable bounce range of the step roller 951) to the predetermined trajectory.

In further another alternative embodiment, the trajectory generation module 140 may further be used to process a plurality of continuous data frames sensed when the movement of the step roller 951 is in the normal state, and execute functions basically the same as those of the predetermined trajectory pattern generation module 150, to generate the predetermined trajectory pattern 970.

Therefore, it will be appreciated that, the predetermined trajectory pattern 970 is a relative concept, and may be set according to a specific situation, for example, set again after the operation condition of the escalator 900 changes or set again after an operation accuracy requirement of the step roller 951 is increased. The predetermined trajectory pattern 970 may be generated in advance before the step roller 951 is monitored, or may be generated offline based on stored data frames.

In the foregoing embodiment, when the state judgment module 160 of the processing device 100 determines that the movement of the monitored step roller 951 is in an abnormal state (for example, when the step roller 951 upthrusts, or severely bounces or sags), a corresponding signal may be sent to the passenger conveyor controller 910 of the escalator 900, to take corresponding measures. For example, the controller 910 reduces the operating speed of the steps; for another example, the controller 910 further sends a signal to the braking component 930 to brake the escalator, to safely stop the movement of the steps. The processing device 200 may further send a signal to an alarm unit 930 mounted above the escalator 900, to remind passengers to watch out, for example, an alarm sound or a prompt message is sent. Definitely, the processing device 200 may further send a signal to a monitoring center 940 of a building, to prompt that on-site processing needs to be performed in time. Specific measures taken when it is found that the movement of the step roller of the escalator 900 is in an abnormal state are not limited.

The step roller monitoring system in the embodiment shown in FIG. 1 can automatically monitor the movement of the step roller 951 of the escalator 900 in real time, and can timely and effectively detect the movement of the step roller 951, so that corresponding measures can be taken in time, avoiding occurrence of safety accidents, and greatly improving operation safety of the escalator.

It should be appreciated that, when the monitoring system according to the embodiment of the present invention performs monitoring based on depth maps obtained by the depth sensing sensor, the depth sensing sensor senses small parts such as the step rollers 951 more accurately, and the depth sensing sensor has a feature of being immune to ambient light intensity changes, and is not affected by the light intensity inside the escalator 900. Therefore, the accuracy of target object training, target object detection, position feature extraction, trajectory generation, and the like is higher, and the judgment is more accurate.

Figure 4:
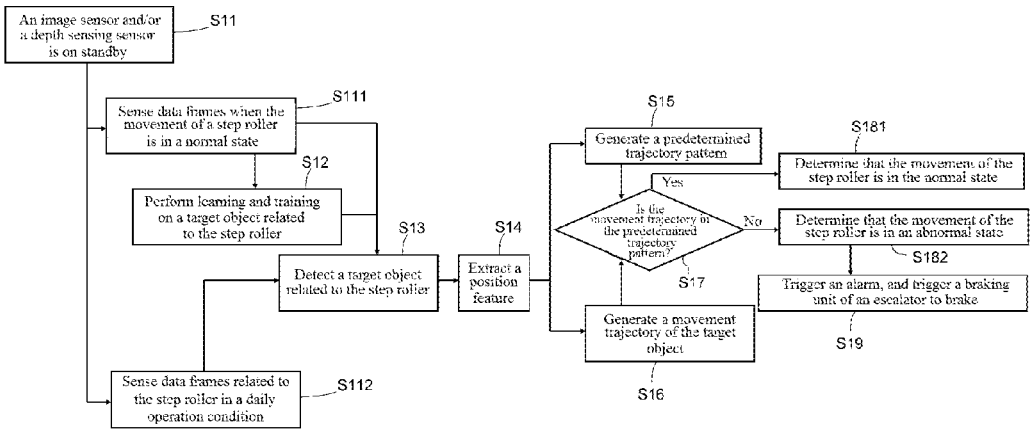
FIG. 4 is a schematic flowchart of a step roller monitoring method of a passenger conveyor according to a first embodiment of the present invention.

In the following, FIG. 4 illustrates a method process of monitoring whether the movement of the step roller is in a normal state by the step roller monitoring system in the embodiment shown in FIG. 1. A working principle of the step roller monitoring system according to the embodiment of the present invention is further described with reference to FIG. 1 and FIG. 4.

First, an imaging sensor and/or a depth sensing sensor is on standby, that is, step S11.

Further, a step of sensing at least a part of the step rollers of the passenger conveyor to obtain data frames, that is, S111 or step S112, is performed. In step S111, data frames when the movement of the step roller is in a normal state are sensed, and the data frames sensed in this step are used for subsequent step S12 and step S13. In step S112, data frames related to the step roller in a daily operation condition are sensed, and the data frames sensed in this step are acquired anytime in the daily operation condition. For example, 30 continuous data frames may be acquired per second, and the acquired data frames are used in subsequent real-time analysis and processing.

Further, in step S12, learning and training are performed on a target object related to the step roller 951. In this step, training and learning are performed according to a step roller manually identified in at least one data frame (obtained in step S111) that is sensed when the movement of the step roller is in the normal state, to develop a target object model related to the step roller 951. This step is accomplished in the target object training module 110 shown in FIG. 1. For a specific learning and training method and the target object model, refer to the above description about the target object training module 110.

Further, in step S13, a target object related to the step roller is detected. In this step, each data frame obtained in step S112 may be detected, thereby monitoring a movement state of the step roller 951 in a daily working condition. Alternatively, each data frame obtained in step S111 may be detected, to generate a predetermined trajectory pattern subsequently. In this step, specifically, the target object related to the step roller 951 may be detected from the data frame based on the target object model. This step is accomplished in the target object detector 120 shown in FIG. 1. For a specific detection method, refer to the above description about the target object detector 120.

Further, in step S14, a position feature is extracted based on the detected target object. This step is accomplished in the position feature extraction module 130 shown in FIG. 1. For a specific extraction method, refer to the above description about the position feature extraction module 130.

Further, in step S15, a predetermined trajectory pattern is generated. In this step, the predetermined trajectory pattern is generated based on the target object obtained corresponding to the plurality of continuous data frames in step S111 and the corresponding position features of the target object. This step is accomplished in the predetermined trajectory pattern generation module 150 shown in FIG. 1, or may be accomplished in the trajectory generation module 140. For a specific extraction method, refer the above description about the predetermined trajectory pattern generation module 150 or the trajectory generation module 140.

Moreover, in step S16, one or more movement trajectories related to the target object are generated according to position features of the target object that are obtained corresponding to the plurality of continuous data frames in step S112. In one embodiment, the same target object detected in the plurality of continuous data frames is traced by using a filtering technology, and a movement trajectory related to the target object is generated by using position features of the same target object that are extracted from the plurality of continuous data frames respectively. This step is accomplished in the trajectory generation module 140 shown in FIG. 1. For a specific generation method, refer to the above description about the trajectory generation module 140.

Further, in step S17, it is judged whether the movement trajectory is in the predetermined trajectory pattern; if the judgment result is "yes", step S181 is performed, to determine that the movement of the step roller 951 is in a normal state; if the judgment result is "no", step S182 is performed, to determine that the movement of the step roller 951 is in an abnormal state. Step S17, step S181, and step S182 are accomplished in the state judgment module 160 shown in FIG. 1. For a specific judgment method, refer to the above description about the state judgment module 160.

Further, when it is determined that the movement of the step roller 951 is in the abnormal state, step S19 is performed, to trigger an alarm, and trigger a braking component of the escalator to brake. Specifically, information may be further triggered to be sent to the monitoring center 940.

So far, one monitoring process on the movement of the step roller 951 of the escalator 900 basically ends. Some steps in this process (such as steps S112, S13, S14, S16 and S17) may be repeatedly and continuously performed, to continuously monitor the movement state of the step roller 951 of the escalator 900. This monitoring method automatically monitors the movement of the step roller 951 of the escalator 900 in real time, and can timely and effectively detect the movement of the step roller 951, so that corresponding measures can be taken in time, avoiding occurrence of safety accidents, and significantly improving the operation safety of the escalator.

Figure 5:
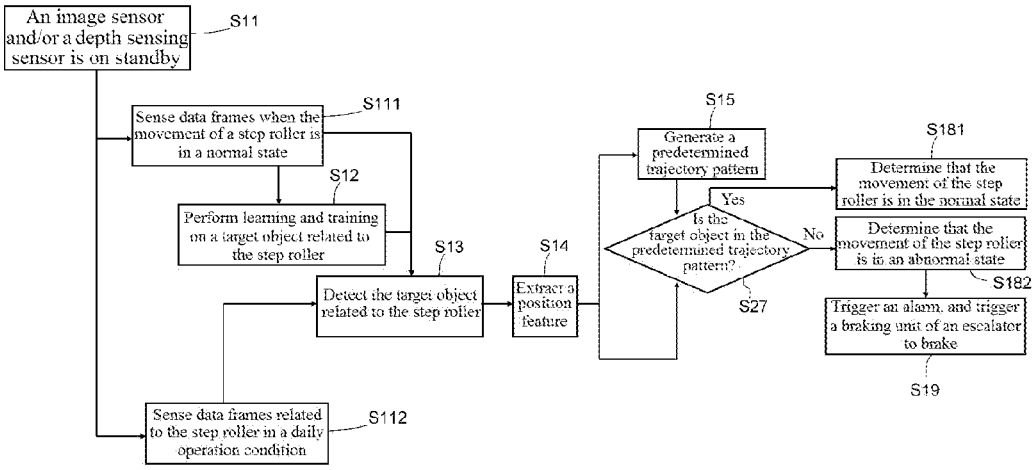
FIG. 5 is a schematic flowchart of a step roller monitoring method of a passenger conveyor according to a second embodiment of the present invention.

FIG. 5 is a schematic flowchart of a step roller monitoring method of a passenger conveyor according to a second embodiment of the present invention. The second embodiment also includes steps S11, S111, S112, S12, S13, S14, S15, S181, S182 and S19 in the first embodiment shown in FIG. 4, and therefore, descriptions thereof are omitted. Compared with the monitoring method in the first embodiment shown in FIG. 4, the main difference lies in the judgment step, that is, step S27. In step S27, whether the target object is in the predetermined trajectory pattern is judged based on the position feature obtained in step S14, and step S181 is performed when the judgment result is "yes"; otherwise, step S182 is performed. Step S27 is also accomplished in the judgment module 160 shown in FIG. 1. In this way, a movement state result of the step roller 951 can be obtained by making a judgment based on a processing result of one data frame.

The applicant notices that, the principle of monitoring the movement of the step roller 951 may be analogically applied to monitoring of activities of maintenance personnel of the escalator 900. Detailed illustrations will be made below.

In the embodiments illustrated below, the maintenance personnel monitoring system and monitoring method according to the embodiments of the present invention are described in detail by using an escalator as an example. However, it should be appreciated that, the maintenance personnel monitoring system and monitoring method for an escalator in the following embodiments may also be analogically applied to a moving walkway. Adaptive improvements or the like that may need to be performed can be obtained by those skilled in the art with the teachings of the embodiments of the present invention.

It should be noted that, in the present invention, that the activity of maintenance personnel of the passenger conveyor is in a "normal state" refers to that the maintenance personnel carries out an action or activity in a predetermined trajectory pattern; on the contrary, an "abnormal state" refers to that the maintenance personnel carries out an action or activity out of the predetermined trajectory pattern, for example, during on-site repair, the maintenance personnel enters a region range (that is, a dangerous region) not belonging to the predetermined trajectory pattern. When the action or activity of the maintenance personnel is in an abnormal state, the maintenance operation of the maintenance personnel absolutely does not conform to requirements of related operation specifications, which may threaten the life of the operating personnel. Therefore, it is necessary to avoid the abnormal state of the action or activity of the maintenance personnel, or detect the dangerous action or activity of the maintenance personnel.

Figure 6:
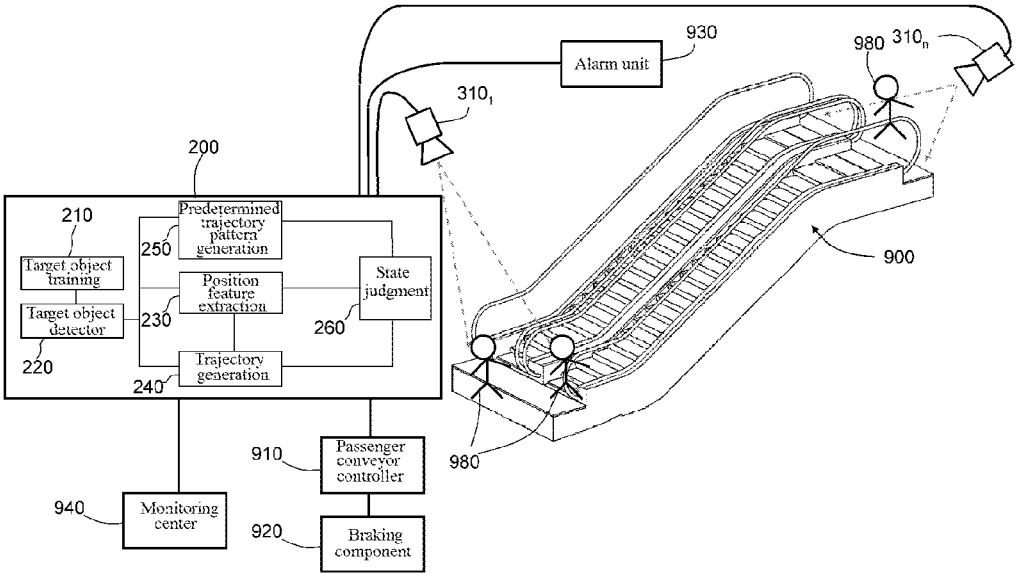
FIG. 6 is a schematic structural diagram of a maintenance personnel monitoring system of a passenger conveyor according to an embodiment of the present invention.

FIG. 6 is a schematic structural diagram of a maintenance personnel monitoring system of a passenger conveyor according to an embodiment of the present invention.

In a repair working condition, for various repair operations, there are corresponding specifications or standards in the prior art to limit activities of maintenance personnel. However, when repairing the escalator 900, the maintenance personnel may easily violate the specifications, especially, entering some forbidden regions, which easily causes severe safety problems.

As shown in FIG. 6, the maintenance personnel monitoring system in this embodiment may be used to continuously monitor whether activities of maintenance personnel 980 of the escalator 900 are in a normal state in a predetermined time period (such as a repair time period).

The maintenance personnel monitoring system in the embodiment shown in FIG. 6 includes a sensing device 310 and a processing device 200 coupled to the sensing device 310. The escalator 900 includes a passenger conveyor controller 910, a braking component 920 such as a motor, an alarm unit 930, and the like. The sensing device 310, the passenger conveyor controller 910, the alarm unit 930 and the like are disclosed in the monitoring system in the embodiment shown in FIG. 1; descriptions thereof are omitted herein.

It should be noted that, the sensing device 310 senses the maintenance personnel 980 of the escalator 900 and acquires a plurality of continuous data frames, that is, sequence frames, in real time. If an imaging sensor is used for sensing and acquisition, the sequence frames are multiple image frames, and each pixel therein has, for example, corresponding grayscale information and color information; if a depth sensing sensor is used for sensing and acquisition, the sequence frames are multiple depth maps, and each pixel or occupancy grid therein also has corresponding a depth dimension (reflecting depth information). The sensing device 310 is mounted in such a manner that it can relatively clearly and accurately sense the activity of the maintenance personnel 980. The specific mounting manner and mounting position thereof are not limited.

The foregoing process of sensing and acquiring data frames by the sensing device 310 may be implemented under control of the processing device 200 or the passenger conveyor controller 910. The data frames sensed and acquired by the sensing device 310 are further sent to the processing device 200. The processing device 200 is further responsible for analyzing and processing each data frame, and finally determining information indicating whether the maintenance personnel 980 of the escalator 900 is in a normal state, for example, determining whether any maintenance personnel 980 enters a dangerous region out of the predetermined trajectory pattern.

Further, as shown in FIG. 6, the processing device 200 is configured to include a target object detector 220, which is configured to detect a target object related to the maintenance personnel 980 from the data frames acquired by the sensing device 310. In this way, a target object corresponding to the maintenance personnel 980 is distinguished from each data frame, to facilitate subsequent processing on the target object. The target object may be the whole maintenance personnel 980 or may be one or more body parts of the maintenance personnel 980. For example, when hand activities of the maintenance personnel 980 are monitored, the target object may include the hands of the maintenance personnel 980. In an embodiment, the target object detector 220 may obtain the target object through learning and training in advance. Therefore, the processing device 200 is further provided with a target object training module 210; the target object training module 210 first acquires at least one data frame sensed when the activity of the maintenance personnel 980 is in a normal state, and the data frame includes the maintenance personnel 980. The maintenance personnel 980 in the data frame is manually identified, for example, a two-dimensional boundary (if the data frame is a two-dimensional image) or a three-dimensional boundary (if the data frame is a three-dimensional depth map) corresponding to the maintenance personnel 980 is identified, i.e., a body contour map or a skeleton map of the maintenance personnel 980 is identified. Further, by using a graphic classification algorithm and the like, and by using a data frame portion corresponding to the identified maintenance personnel 980, learning and training are carried out to obtain a target object model related to the maintenance personnel 980. The target object model includes features such as the skeleton shape of the maintenance personnel 980, and therefore, the target object model reflects lots of feature information of the maintenance personnel 980. The resolution of the skeleton map may be more refined, and may include finger positions, a wrist position and the like of the hand. By using the target object model trained by the target object training module 210, the target object detector 220 can accurately detect or identify the target object related to the maintenance personnel 980 from a subsequent data frame acquired online or offline.

It should be noted that, the detection accuracy degree of the target object detector 220 is related to a learning and training effect of the target object training module 210. If the learning and training are performed more times, it is possible that the target object model can more accurately reflect feature information about the maintenance personnel 980, and therefore the target object related to the maintenance personnel 980 can be detected more accurately. The learning and training process of the target object training module 210 for the maintenance personnel 980 may be finished offline in advance. The target object detector 220 may continuously operate online, to continuously detect the target object related to the maintenance personnel 980 in each data frame.

Further, as shown in FIG. 6, the processing device 200 is further provided with a position feature extraction module 230. The position feature extraction module 230 extracts a corresponding feature from the detected target object, especially including extracting a position feature of the target object. Information such as the position feature may be defined by distance values (2D plane distances or 3D distances) from multiple feature points or pixels/grids of the target object to a reference point.

Further, as shown in FIG. 6, the processing device 200 is further provided with a trajectory generation module 240. The trajectory generation module 240 generates one or more activity trajectories related to the target object according to position features of the target object that are obtained corresponding to a plurality of continuous data frames. Specifically, the position features obtained by the position feature extraction module 230 and the target object detected by the target object detector 220 are processed in the trajectory generation module 240. In the trajectory generation module 240, a Bayesian Filter technology is used to trace a same target object in continuous data frames. In this way, among multiple target objects obtained from data frames in a predetermined time period, a same correspondingly target object may be obtained by means of tracing. Further, based on position information (obtained from the position feature extraction module 230) of the same target object traced in each data frame, one or more activity trajectories of the maintenance personnel 980 corresponding to the target object in the predetermined time period are generated. The specific Bayesian Filter technology may be, but not limited to, Kalman Filter, Particle Filter, and the like.

The above multiple activity trajectories generated by the trajectory generation module 240 may allow maintenance personnel operation behaviors in different sequences, wherein these sequences are all acceptable or allowed. For example, during a repair operation, it is acceptable or allowed to fasten a housing of some apparatuses with four screws in different sequences, but it is not allowed to fasten a housing of some apparatuses with only three screws, and this case may be defined as an abnormal state.

The trajectory generation module 240 may further identify or classify activity trajectories of activities or behaviors (e.g., unscrewing, removing a housing, lubricating parts, or the like). Specifically, behavior identification technologies such as Probabilistic Programming, Markov Logic Networks, and Convolutional Neural networks may be used. According to the above classification of the trajectory generation module 240, a corresponding explanation may be provided to the maintenance personnel 980 subsequently by using the alarm unit 930. For different classes of activity trajectories, corresponding trajectory models may be established in advance by means of training. During identification, the movement trajectory may be compared with a corresponding trajectory model to identify the class of the movement trajectory.

Further, as shown in FIG. 6, the processing device 200 is further provided with a state judgment module 260. The state judgment module 260 may be coupled to the position feature extraction module 230 and the trajectory generation module 240, and acquire the position feature of the target object related to the maintenance personnel 980 and the corresponding activity trajectory. Moreover, the state judgment module 260 may further store or provided in advance with a predetermined trajectory pattern 971. The state judgment module 260 judges, based on an activity trajectory of the corresponding target object in a predetermined time period and the predetermined trajectory pattern, whether the activity trajectory is in the predetermined trajectory pattern, and if the judgment result is "yes", determines that the activity of the maintenance personnel 980 corresponding to the target object is in a normal state in the predetermined time period; otherwise, the activity of the maintenance personnel 980 is in an abnormal state.

In the foregoing embodiment, judgment by the state judgment module 260 based on the activity trajectory is a dynamic judgment process, and the judgment is made based on multiple data frames. Therefore, the judgment is relatively more accurate and reasonable, the judgment result has high credibility. Especially, after the filtering technology is used during the process of generating the activity trajectory, when a large error randomly occurs in target object detection on a data frame, the detection result may be directly filtered out, thus significantly improving the judgment accuracy.

In an embodiment, as shown in FIG. 6, the processing device 200 is further provided with a predetermined trajectory pattern generation module 250, which may generate the predetermined trajectory pattern of the maintenance personnel 980 based on a plurality of continuous data frames sensed when the activity of the maintenance personnel 980 is in the normal state. The predetermined trajectory pattern generation module 250 is coupled to the target object detector 220 and the position feature extraction module 230, and the principle of generating a predetermined trajectory thereof is basically the same as the principle of generating the activity trajectory by the trajectory generation module 240, only that different data frames are used; descriptions of the predetermined trajectory pattern generation module 250 are omitted herein. The predetermined trajectory obtained by the predetermined trajectory pattern generation module 250 is a standard activity trajectory obtained when the maintenance personnel 980 follows the repair operation standards. It should be appreciated that, the predetermined trajectory pattern can be generated by adding a range (such as a tolerable range or a range that the maintenance personnel 980 is allowed to access) to the predetermined trajectory. For 2D images, the predetermined trajectory pattern may be a 2D plane range; for 3D depth maps obtained by the depth sensing sensor, the predetermined trajectory pattern may be a 3D space range. In the range corresponding to the predetermined trajectory pattern, at least activities of the maintenance personnel are safe.

In another alternative embodiment, the trajectory generation module 240 may further be used to process a plurality of continuous data frames sensed when the activity of the maintenance personnel 980 is in the normal state, and execute functions basically the same as those of the predetermined trajectory pattern generation module 250, to generate the predetermined trajectory pattern.

Therefore, it will be appreciated that, the predetermined trajectory pattern is a relative concept, and may be set according to a specific situation, for example, set again after the repair operation standards of the escalator 900 change or set again after an activity accuracy requirement of the maintenance personnel 980 is increased. The predetermined trajectory pattern may be generated in advance before the maintenance personnel 980 is monitored, or may be generated offline based on stored data frames.

It should be noted that, for different repair working conditions of the escalator 900, different predetermined trajectory patterns may be generated. During monitoring, based on the repair working condition type monitored currently, the judgment module 260 selects a corresponding predetermined trajectory pattern to be compared with the activity trajectory of the maintenance personnel 980.

In the foregoing embodiment, when the state judgment module 260 in the processing device 200 determines that the activity of the monitored maintenance personnel 980 is in an abnormal state (for example, when the maintenance personnel 980 violates the specifications and enters a dangerous region), a signal may be sent to an alarm unit 930 mounted above the escalator 900, to prompt the maintenance personnel 980 that the operation violates the specifications, for example, an alarm sound or a prompt message is sent. Certainly, the processing device 200 may further send a signal to the monitoring center 940 of a building, to remind a manager to perform corresponding processing, so as to avoid occurrence of severe accidents. Specific measures taken when it is found that the activity of the maintenance personnel of the escalator 900 is in an abnormal state are not limited.

The maintenance personnel monitoring system in the embodiment shown in FIG. 6 can automatically monitor the activity of the maintenance personnel 980 of the escalator 900 in real time, and can timely and effectively detect the movement of the maintenance personnel 980 that is dangerous or violates the specifications, so that corresponding measures can be taken in time, avoiding occurrence of safety accidents, ensuring safety of repair operations, and also facilitating management on the maintenance personnel.

Figure 7:
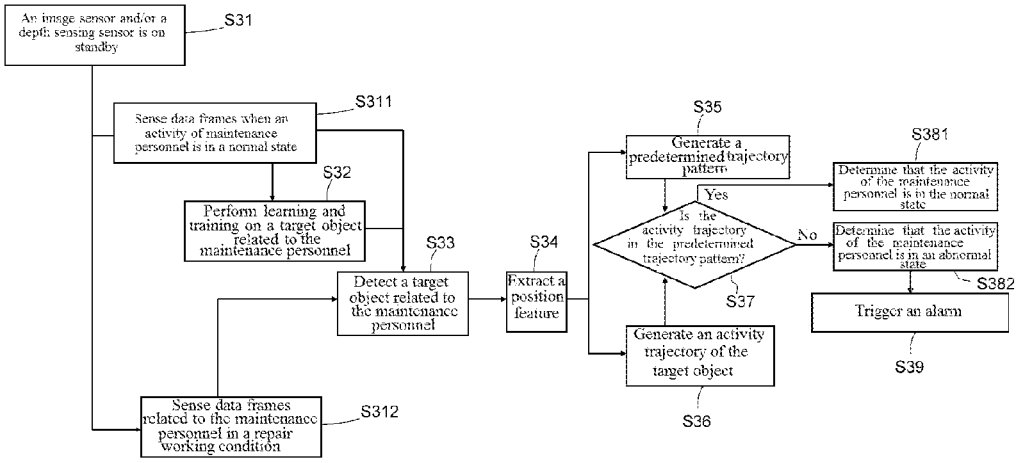
FIG. 7 is a schematic flowchart of a method for monitoring activities of maintenance personnel of a passenger conveyor according to an embodiment of the present invention.

In the following, FIG. 7 illustrates a method process of monitoring whether the activity of the maintenance personnel is in a normal state by the maintenance personnel monitoring system in the embodiment shown in FIG. 6. A working principle of the monitoring system according to the embodiment of the present invention is further described with reference to FIG. 6 and FIG. 7.

First, an imaging sensor and/or a depth sensing sensor is on standby, that is, step S31.

Further, maintenance personnel on or near the passenger conveyor is sensed to obtain data frames, that is, S311 or step S312. In step S311, data frames when an activity of the maintenance personnel is in a normal state are sensed, and the data frames sensed in this step are used for subsequent step S32 and step S33. In step S312, data frames related to the maintenance personnel in a repair working condition are sensed, and the data frames sensed in this step are acquired anytime in the repair working condition. For example, 30 continuous data frames may be acquired per second, and the acquired data frames are used in subsequent real-time analysis and processing.

Further, in step S32, learning and training are performed on a target object related to the maintenance personnel 980. In this step, training and learning are performed according to the maintenance personnel manually identified in at least one data frame (obtained in step S311) that is sensed when the activity of the maintenance personnel is in the normal state, to develop a target object model related to the maintenance personnel 980. This step is accomplished in the target object training module 210 shown in FIG. 6. For a specific learning and training method and the target object model, refer to the above description about the target object training module 210.

Further, in step S33, a target object related to the maintenance personnel is detected. In this step, detection may be performed on each data frame obtained in step S312, thereby monitoring an activity state of the maintenance personnel 980 in the repair working condition. Alternatively, detection may be performed on each data frame obtained in step S311, to generate a predetermined trajectory pattern subsequently. In this step, specifically, the target object related to the maintenance personnel 980 may be detected from the data frame based on the target object model. This step is accomplished in the target object detector 220 shown in FIG. 6. For a specific detection method, refer to the above description about the target object detector 220.

Further, in step S34, a position feature is extracted based on the detected target object. This step is accomplished in the position feature extraction module 230 shown in FIG. 6. For a specific extraction method, refer to the above description about the position feature extraction module 230.

Further, in step S35, a predetermined trajectory pattern is generated. In this step, the predetermined trajectory pattern is generated based on the target object obtained corresponding to the plurality of continuous data frames in step S311 and the corresponding position features of the target object. This step is accomplished in the predetermined trajectory pattern generation module 250 shown in FIG. 6, or may be accomplished in the trajectory generation module 240. For a specific extraction method, refer the above description about the predetermined trajectory pattern generation module 250 or the trajectory generation module 240.

Moreover, in step S36, one or more activity trajectories related to the target object are generated according to position features of the target object that are obtained corresponding to the plurality of continuous data frames in step S312. In one embodiment, the same target object detected in the plurality of continuous data frames is traced by using a filtering technology, and an activity trajectory related to the target object is generated by using position features of the same target object that are extracted from the plurality of continuous data frames respectively. This step is accomplished in the trajectory generation module 240 shown in FIG. 6. For a specific generation method, refer to the above description about the trajectory generation module 240.

Further, in step S37, it is judged whether the activity trajectory is in the predetermined trajectory pattern; if the judgment result is "yes", step S381 is performed, to determine that the activity of the maintenance personnel 980 is in a normal state; if the judgment result is "no", step S382 is performed, to determine that the activity of the maintenance personnel 980 is in an abnormal state. Step S37, step S381, and step S382 are accomplished in the state judgment module 260 shown in FIG. 6. For a specific judgment method, refer to the above description about the state judgment module 260.

Further, when it is determined that the activity of the maintenance personnel 980 is in the abnormal state, step S39 is performed, to trigger an alarm, thereby reminding the maintenance personnel that the operation violates the specifications. Specifically, information may be further triggered to be sent to the monitoring center 940.

So far, one monitoring process on the activity of the maintenance personnel 980 of the escalator 900 basically ends. Some steps in this process (such as steps S312, S33, S34, S36 and S37) may be repeatedly and continuously performed, to continuously monitor the activity state of the maintenance personnel 980 of the escalator 900.

It should be noted that the elements disclosed and depicted herein (including flow charts and block diagrams in the accompanying drawings) imply logical boundaries between the elements. However, according to software or hardware engineering practices, the depicted elements and the functions thereof may be implemented on machines through a computer executable medium. The computer executable medium has a processor capable of executing program instructions stored thereon as a monolithic software structure, as standalone software modules, or as modules that employ external routines, code, services, and so forth, or any combination thereof, and all such implementations may fall within the scope of the present disclosure.

Although the different non-limiting implementation solutions have specifically illustrated assemblies, the implementation solutions of the present invention are not limited to those particular combinations. It is possible to use some of the assemblies or features from any of the non-limiting implementation solutions in combination with features or assemblies from any of other non-limiting implementation solutions.

Although particular step sequences are shown, disclosed, and claimed, it should be appreciated that the steps may be performed in any order, separated or combined, unless otherwise indicated and will still benefit from the present disclosure.

The foregoing description is exemplary rather than defined by the limitations within. Various non-limiting implementation solutions are disclosed herein, however, persons of ordinary skill in the art would recognize that various modifications and variations in light of the above teachings will fall within the scope of the appended claims. It is therefore to be appreciated that within the scope of the appended claims, the disclosure may be practiced other than as specifically disclosed. For that reason, the appended claims should be studied to determine the true scope and content.

The invention claimed is:

1. A step roller monitoring system of a passenger conveyor, comprising:

an imaging sensor and/or a depth sensing sensor configured to sense at least a part of the step rollers of the passenger conveyor to acquire data frames; and a processing device configured to analyze and process the data frames to monitor whether the movement of the operating step roller and/or a position of the static step roller is in a normal state, wherein the normal state refers to that the movement and/or position of the step roller is in a predetermined trajectory pattern;

wherein the processing device is configured to further comprise a predetermined trajectory pattern generation module configured to generate the predetermined trajectory pattern based on position features of a target object that are obtained corresponding to the data frames sensed when the movement of the operating step roller and/or the position of the static step roller is in the normal state.

2. The step roller monitoring system according to claim 1, wherein the processing device is configured to comprise:

a target object detector configured to detect the target object related to the step roller from the data frames;

a position feature extraction module configured to extract a position feature based on the detected target object;

a trajectory generation module configured to generate a movement trajectory related to the target object according to position features of the target object that are obtained corresponding to the plurality of continuous data frames; and a state judgment module configured to judge whether the movement trajectory is in the predetermined trajectory pattern, and determine that the movement of the step roller and/or the position of the static step roller is in the normal state when the judgment result is "yes".

3. The step roller monitoring system according to claim 2, wherein the state judgment module is further configured to: judge, based on the position feature, whether the target object is in the predetermined trajectory pattern, and determine that the movement of the step roller and/or the position of the static step roller is in the normal state when the judgment result is "yes".

4. The step roller monitoring system according to claim 2, wherein the trajectory generation module is further configured to: trace, in a plurality of continuous data frames by using a filtering technology, a same target object detected by the target object detector, and generate the movement trajectory related to the target object by using position features of the same target object that are extracted by the position feature extraction module from the plurality of continuous data frames respectively.

5. The step roller monitoring system according to claim 4, wherein the filtering technology is Kalman Filter or Particle Filter.

6. The step roller monitoring system according to claim 2, wherein the trajectory generation module is further configured to generate the predetermined trajectory pattern according to position features of the target object that are obtained corresponding to the plurality of continuous data frames sensed when the movement of the step roller and/or the position of the static step roller is in the normal state.

7. The step roller monitoring system according to claim 2, wherein the processing device is configured to further comprise:

a target object training module configured to perform learning and training according to the step roller manually identified in at least one data frame sensed when the movement of the step roller is in the normal state, to develop a target object model related to the step roller; and wherein the target object detector detects, based on the target object model, the target object related to the step roller from the data frame.

8. The step roller monitoring system according to claim 1, wherein the imaging sensor/depth sensing sensor comprises one or more imaging sensors/depth sensing sensors mounted approximately facing side faces of steps of the passenger conveyor.

9. The step roller monitoring system according to claim 8, wherein the depth sensing sensor mounted approximately facing the side face of the step of the passenger conveyor is mounted inside the passenger conveyor.

10. The step roller monitoring system according to claim 8, wherein the imaging sensor mounted approximately facing the side face of the step of the passenger conveyor is mounted inside the passenger conveyor, and a lighting part is mounted inside the passenger conveyor.

11. The step roller monitoring system according to claim 1, wherein the step roller monitoring system further comprises an alarm unit, and the processing device triggers the alarm unit to work when determining that the movement of the step roller is in an abnormal state, wherein the abnormal state refers to that the movement and/or position of the step roller is not in the predetermined trajectory pattern.

12. The step roller monitoring system according to claim 1, wherein the processing device is further configured to trigger outputting of a signal when determining that the movement of the step roller is in an abnormal state, to enable a braking component of the passenger conveyor to work.

13. A step roller monitoring method of a passenger conveyor, comprising steps of:

sensing, by an imaging sensor and/or a depth sensing sensor, at least a part of the step rollers of the passenger conveyor to acquire data frames; and analyzing and processing the data frames to monitor whether the movement of the operating step roller and/or a position of the static step roller is in a normal state, wherein the normal state refers to that the movement and/or position of the step roller is in a predetermined trajectory pattern and triggering an alarm unit to work upon determining that the movement of the operating step roller is in an abnormal state, wherein the abnormal state refers to that the movement and/or position of the operating step roller is not in the predetermined trajectory pattern.

14. The step roller monitoring method according to claim 13, wherein the analysis and processing step comprises:

detecting a target object related to the step roller from the data frames;

extracting a position feature based on the detected target object;

generating a movement trajectory related to the target object according to position features of the target object that are obtained corresponding to the plurality of continuous data frames; and judging whether the movement trajectory is in the predetermined trajectory pattern, and determining that the movement of the step roller and/or the position of the static step roller is in the normal state when the judgment result is "yes".

15. The step roller monitoring method according to claim 14, wherein, in the judgment step, it is further judged, based on the position feature, whether the target object is in the predetermined trajectory pattern, and it is determined that the movement of the step roller and/or the position of the static step roller is in the normal state when the judgment result is "yes".

16. The step roller monitoring method according to claim 14, wherein, in the step of generating a movement trajectory, the same target object detected by the target object detector in a plurality of continuous data frames is traced by using a filtering technology, and the movement trajectory related to the target object is generated by using position features of the same target object that are extracted by the position feature extraction module from the plurality of continuous data frames respectively.

17. The step roller monitoring method according to claim 16, wherein the filtering technology is Kalman Filter or Particle Filter.

18. The step roller monitoring method according to claim 14, wherein, in the step of generating a movement trajectory, the predetermined trajectory pattern is generated according to position features of the target object that are obtained corresponding to the plurality of continuous data frames sensed when the movement of the step roller and/or the position of the static step roller is in the normal state.

19. The step roller monitoring method according to claim 14, wherein the analysis and processing step further comprises:

performing learning and training according to the step roller manually identified in at least one data frame sensed when the movement of the step roller and/or the position of the static step roller is in the normal state, to develop a target object model related to the step roller;

wherein, in the target object detection step, the target object related to the step roller is detected from the data frame based on the target object model.

20. The step roller monitoring method according to claim 14, wherein the analysis and processing step further comprises:

generating the predetermined trajectory pattern based on position features of the target object that are obtained corresponding to the plurality of continuous data frames sensed when the movement of the step roller is in the normal state.

21. The step roller monitoring method according to claim 13, wherein the analysis and processing step further comprises:

triggering outputting of a signal when determining that the movement of the step roller and/or position of the static step roller is in an abnormal state, to enable a braking component of the passenger conveyor to work.

* * * * *